United States Patent [19]

Phillips, Jr. et al.

[11] 4,318,239

[45] Mar. 9, 1982

[54] FRONT LOADER FOR REVOLVERS

[76] Inventors: Jonathan W. Phillips, Jr., 210 E. 4th St., Houston, Tex. 77007; Ted E. Bailey, Jr., 4023 Tartan La., Houston, Tex. 77025; C. L. Bailey, Jr., Rte. 3, Box 327 A, Houston, Tex. 77045

[21] Appl. No.: 137,649

[22] Filed: Apr. 7, 1980

[51] Int. Cl.[3] ..... F42B 39/04

[52] U.S. Cl. ..... 42/89; 42/61

[58] Field of Search ..... 42/89, 61, 62, 59

[56] References Cited

U.S. PATENT DOCUMENTS

| | | | |
|---|---|---|---|
| 1,964,171 | 6/1934 | Pflaume | 42/89 |
| 3,541,716 | 11/1970 | Fordham et al. | 42/89 |
| 3,769,732 | 11/1973 | Griffis | 42/89 |

*Primary Examiner*—Charles T. Jordan

*Attorney, Agent, or Firm*—Ranseler O. Wyatt

[57] ABSTRACT

A device for loading revolvers from the front of the cylinder, a rotating cylinder in the revolver designed to releasably retain cartridges therein and to receive new loads from the loader and at the same time eject the empty casings. The rotating cylinder has a pivotal yoke and an arm extending laterally therefrom with a locking means for releasably maintaining the revolver cylinder in firing position on the frame. Guides are provided for aligning the cartridge chambers of the respective cylinders with each other. A loading cylinder abuts the revolver cylinder for reloading. A series of rams are provided which are movable against the reloading cartridges and which will contact the spent casings in the revolver cylinder and eject same. Casing retainers in the revolver cylinder will secure the reloads in place therein. A back plate mounted on the rear end face of the revolver cylinder maintains the holding means in the chambers in holding position.

5 Claims, 9 Drawing Figures

FRONT LOADER FOR REVOLVERS

BACKGROUND OF THE INVENTION

In firing the revolver, as in matches, and the like, the time required to open the cylinder, eject the spent casings, and then reload the cylinder chambers, is critical, particularly in rapid fire events, where the user is required to fire several loads within a given time. The object of this invention is to provide a quick loading means that moves the new loads, all at the same time, into the cylinder chambers and ejects the spent casings, reducing the time for reloading. Reloaders for revolvers have been known in the art, such as half moon clips, holding three cartridges, loading from the rear, but they require first the ejection of the spent casings, then inserting the new loads into the cylinder, then removal of the clips and closing the cylinder. In a preliminary search of the Patent Office records, the patent to Pflaume, U.S. Pat. No. 1,964,171 was found, which held a full load of cartridges for the revolver cylinder, but which again required first the ejection of the spent casings, and then, in a separate movement, inserting the new loads into the cylinder. This patent teaches the loading from the rear of the cylinder, not the front, and literally dropping the cartridges, by gravity, into the chambers of the revolver cylinder.

SUMMARY OF THE INVENTION

A front loading mechanism for revolvers having multiple chamber cylinders, an inclosed housing having rams therein, one for each chamber of the revolver cylinder, and having cartridge containing chambers with yieldable retaining means for maintaining the cartridges in the chambers and one end face of the housing having projecting alignment members and a lateral slot to receive a portion of the pivotal yoke holding the revolver cylinder in place.

DESCRIPTION OF THE PREFERRED EMBODIMENT

Figure 1:
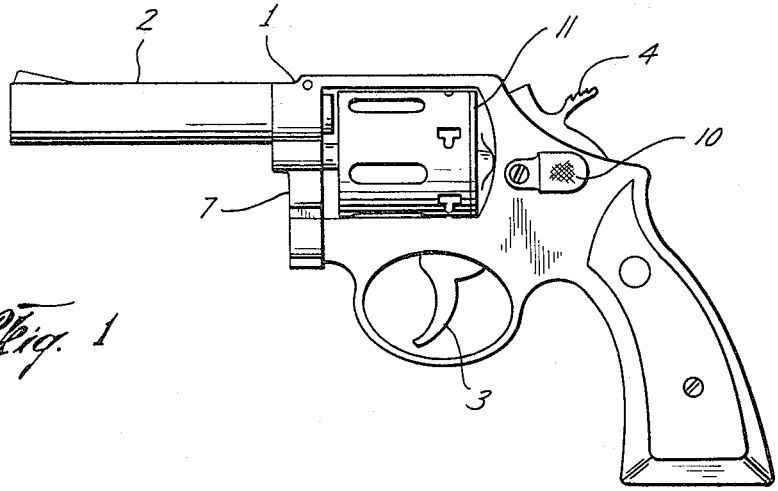
FIG. 1 is a side elevational view of a revolver having a cartridge containing cylinder.
Figure 2:
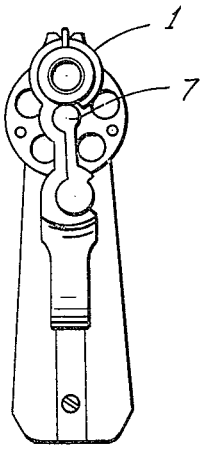
FIG. 2 is a front elevational view with the cylinder in firing position.
Figure 3:
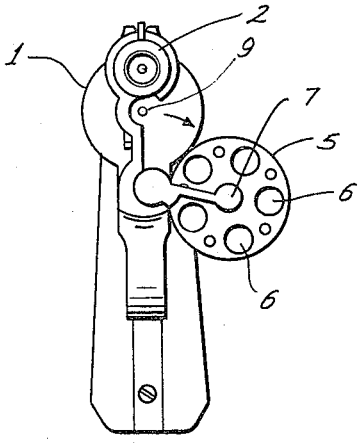
FIG. 3 is a front elevational view of the cylinder in reloading position.
Figure 4:
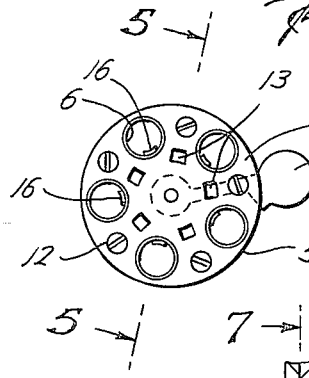
FIG. 4 is an end view of the revolver cylinder.
Figure 5:
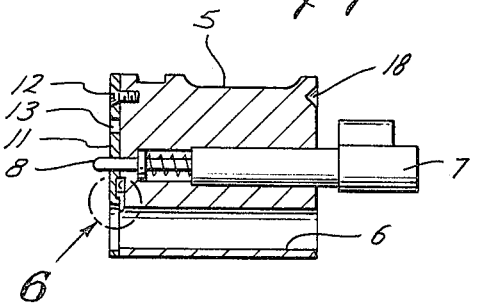
FIG. 5 is a cross sectional side elevational view taken on the line 5—5 of FIG. 4.
Figure 6:
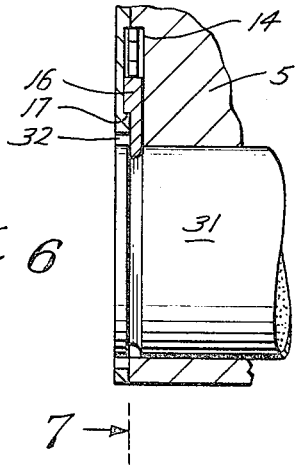
FIG. 6 is a cross sectional elevation view, enlarged, of the encircled area marked 6, of FIG. 5.
Figure 7:
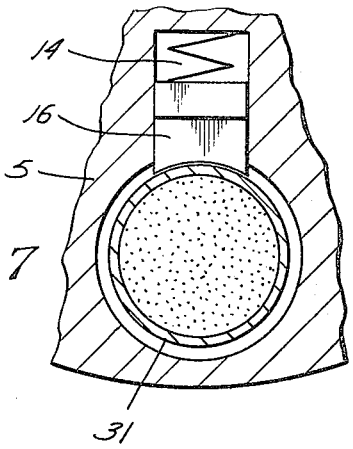
FIG. 7 is a cross sectional elevational frontal view, taken on the line 7—7 of FIG. 6, showing the cartridge retainer in retaining position.
Figure 8:
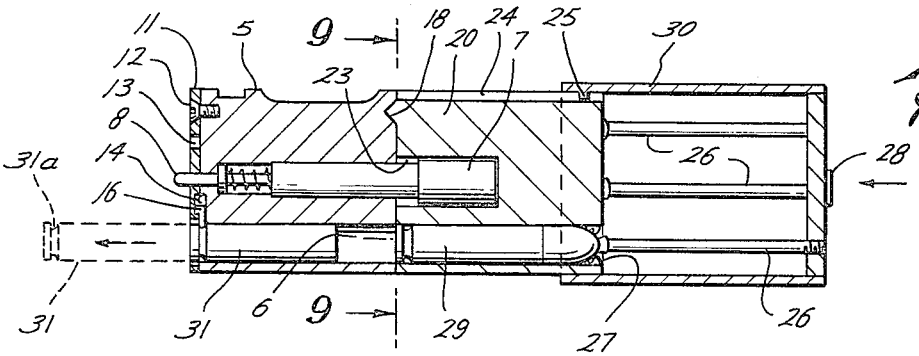
FIG. 8 is a side elevational view, in cross section, of the loader in engagement with the revolver cylinder prepared to reload, showing the spent casing ejected in dotted lines.
Figure 9:
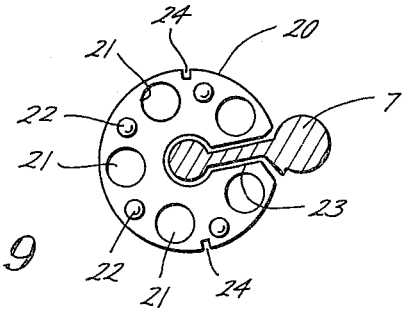
FIG. 9 is an end view of the loader, mounted on the yoke.

In the drawings, the numeral 1 designates a revolver frame having the usual barrel 2, trigger 3 and hammer 4. A cylinder 5, having cartridge chambers 6, 6, is pivotally mounted on the frame 1 by means of a yoke 7 having a laterally extended arm mounted axially in said cylinder 5 and having a yieldable locking pin 8 in the extended end of said arm which enters a port 9 in the frame 1 when the cylinder 5 is in firing position on the frame, and which is moved out of locking position by the thumb operated slide 10, slidably mounted on the frame 1, and which bears against the extended end of the locking pin 8 in the usual manner of releasing revolver cylinders. The yoke 7 is mounted on the frame 1, with one end thereof pivotally mounted in the frame below the cylinder, and is adapted to swing outwardly, when the pin 8 is released, the swinging movement terminating by abutment of the cylinder against the frame 1 adjacent the trigger. A back plate 11 is mounted on one end of the cylinder, by means of the set screws 12, 12, and a series of openings 13, 13 are provided in the plate 11 to receive the usual racheting means of the revolver (not shown) for rotating the cylinder. Formed in the inside face of the back plate 11, are cartridge holding latch chambers 14, 14, which are aligned with the matching chambers in the cylinder, and in said latch chambers are mounted spring loaded cartridge retainers 16, there being one of said chambers and cartridge holding retainers for each cartridge chamber 6.

In said latch chamber, each chamber 14 has a restricted area forming a shoulder 17, which acts as a stop for the outward movement of the retainer 16. On the opposite end of the cylinder, are guide receiving indentations 18.

The loader cylinder 20 has chambers 21 matching the chambers 6 in the cylinder 5, and has the outwardly projecting guides 22 adapted to be received by the indentations 18 in the end face of the cylinder 5. A deep indentation 23 is formed axially in the cylinder 20 and extends laterally across the face of the cylinder 20, at the end abutting the cylinder 5 when in reloading position. A housing 30 extends over the cylinder 20, and has grooves 24 formed longitudinally on the outer surface thereof. Inwardly projecting members as 25, 25 on the inside wall of the housing fit in said grooves and maintain the housing in sliding relation on the cylinder 20.

Extending longitudinally within said housing and secured to one end thereof are the rams 26, 26, which are enlarged at one end thereof, that being the extended ends, and are positioned to axially pass through said cartridge chambers 21, 21. The chambers 21 are provided with cartridge retainers 27, which are flexible stops in the chambers 21, 21 at one end, the said retaining means, as defined for the cylinder 5, consisting of the spring loaded latch members 16, may be employed if desired, in lieu of the flexible stops 27. A guide button 28 is mounted on the top of the housing 30 to assist the user in aligning the loader cylinder 20 with the revolver cylinder 5.

Cartridge loads 29 are placed in the loader chamber 21, with the housing 30 in extended position. When it is desired to reload, the slide 10 is moved forwardly by the thumb of the user, and the pin 8 moved inwardly out of engagement, and the cylinder 5 pivoted outwardly on the yoke 7. The guide 28, the projections 22 of the loader and the countersunk yoke receiving indentation 23 are employed to quickly guide the loader into loading position on the cylinder 5 and when in place, the housing 30 is depressed, forcing the cartridges 29 into the chambers 6 of the cylinder 5, and as the ends of the cartridges 29 abut the spent casings 31, the continued depression of the housing 30 will eject the casing 31, the latch means 14 yielding to permit the release of the casing, and as the housing reaches the end of its stroke, the latch members 14 will engage the grooves 31*a* of the cartridges 29 and hold them in place as the loader is removed and the cylinder 5 pivoted back into firing position in the frame 1.

Each chamber is slightly enlarged at the rearward end 32 of the cylinder 5, so that regular standard cartridges may be loaded from the rear, if desired, the end of the retainers 16 being rounded, will permit such loading by yielding to the pressure of the cartridge entering from the rear. In loading in this manner, it will be necessary, of course, to first extract the spent casing.

What we claim is:

1. In a reloader, a revolver frame having a revolving cylinder having cartridge chambers therein and the cylinder having a back plate on one end and cartridge engaging latch means extending into each of said chambers and in engagement with cartridges loaded therein, a yoke pivotally mounted on said frame and having a lateral extension thereon extending axially through said cylinder and having means for releasably locking said cylinder in place on said frame, a reloading cylinder having reload cartridge chambers therein and being movable against the front end of said revolver cylinder, with the chambers of said cylinders in alignment and means on said reloading cylinder for moving cartridges out of the chambers thereof into the chambers of said revolver cylinder, overcoming the retaining means therein and removing the cartridge casings in said revolver cylinder and latching said reload cartridges in place in said revolver cylinder.

2. The device defined in claim 1 wherein each chamber of said reloading cylinder is provided with cartridge retaining means for yieldably retaining the cartridges therein.

3. The device defined in claim 1 wherein said cartridge removing means in said reload cylinder consists of a series of rams, one opposite each cartridge chamber, positioned to extend axially into said cartridge chamber, a slidable housing on said reload cylinder in which said rams are mounted, said housing moving said rams against the cartridges in said reload cylinder as said housing is moved into non extended position.

4. The device defined in claim 1 wherein chambers are formed in the face of one end of said revolving cylinder, and aligned chambers in the inside face of said back plate, spring loaded latch means in said chambers and extending into said cartridge chambers and in yieldable engagement with the cartridges therein, rams in said reload cylinder, said latch means retracting upon pressure from said rams against said cartridge casings, and extending engagement with the reload cartridges as they move to firing position in said revolver cartridge chambers.

5. The device defined in claim 1 wherein said reloading cylinder has a lateral slot therein into which said yoke extends as the reloading chamber is moved into reloading position.

* * * * *